US009123496B2

(12) United States Patent
Jang

(10) Patent No.: US 9,123,496 B2
(45) Date of Patent: Sep. 1, 2015

(54) MOLDED CASE CIRCUIT BREAKER WITH LARGE CAPACITY

(71) Applicant: LSIS CO., LTD., Anyang-si, Gyeonggi-do (KR)

(72) Inventor: Jun Yong Jang, Cheongju-si (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 14 days.

(21) Appl. No.: 14/046,854

(22) Filed: Oct. 4, 2013

(65) Prior Publication Data

US 2014/0116866 A1 May 1, 2014

(30) Foreign Application Priority Data

Nov. 1, 2012 (KR) ..... 20-2012-0009997 U

(51) Int. Cl.
*H01H 1/64* (2006.01)
*H01H 1/22* (2006.01)
(Continued)

(52) U.S. Cl.
CPC ..... *H01H 71/50* (2013.01); *H01H 1/64* (2013.01); *H01H 1/226* (2013.01); *H01H 2009/305* (2013.01)

(58) Field of Classification Search
CPC ..... H01H 1/64; H01H 1/226; H01H 9/02; H01H 2009/305; H01H 77/107; H01H 71/10; H01H 71/50; H01H 73/18; H01H 31/28
USPC ..... 218/89, 154, 155, 41, 147; 200/293
See application file for complete search history.

(56) References Cited

U.S. PATENT DOCUMENTS 4,431,877 A 2/1984 Heft et al.
2001/0027961 A1* 10/2001 Brouillat et al. ..... 218/154
2010/0032269 A1* 2/2010 Schaltenbrand et al. ..... 200/244
(Continued)

FOREIGN PATENT DOCUMENTS

CN 103545147 1/2014
EP 0543496 5/1993
(Continued)

OTHER PUBLICATIONS

European Patent Office Application Serial No. 13188271.4, Search Report dated Feb. 13, 2014, 10 pages.
(Continued)

*Primary Examiner* — Renee Luebke
*Assistant Examiner* — William Bolton
(74) *Attorney, Agent, or Firm* — Lee, Hong, Degerman, Kang & Waimey

(57) ABSTRACT

A molded case circuit breaker comprises: a plurality of stationary contact arms; a plurality of movable contact arms each having a plurality of contact arm pieces; a switching mechanism providing a driving force to move the movable contact arms to a closing position or an opening position; a driving shaft configured to provide a driving force for simultaneously rotating the movable contact arms; a link configured to transmit a driving force; a holder configured to rotate the movable contact arms; an upper arc barrier configured to prevent arcs from moving to a rear side from an upper side of the movable contact arms; and a torsion spring having one end portion contacting upper surface of the movable contact arms on the opening position, so as to provide an elastic force to the movable contact arms such that the movable contact arms are rotated to the closing position.

4 Claims, 5 Drawing Sheets

(51) Int. Cl.
*H01H 9/30* (2006.01)
*H01H 71/50* (2006.01)

(56) References Cited

U.S. PATENT DOCUMENTS

| | | | | |
|---|---|---|---|---|
| 2011/0193660 | A1* | 8/2011 | Baek | 335/15 |
| 2014/0008190 | A1* | 1/2014 | Seo et al. | 200/293 |
| 2014/0305906 | A1* | 10/2014 | Baek | 218/156 |

FOREIGN PATENT DOCUMENTS

| | | |
|---|---|---|
| EP | 2685481 | 1/2014 |
| KR | 101052645 | 7/2011 |

OTHER PUBLICATIONS

The State Intellectual Property Office of the People's Republic of China Application Serial No. 201310473531.8, Office Action dated May 5, 2015, 6 pages.

* cited by examiner

MOLDED CASE CIRCUIT BREAKER WITH LARGE CAPACITY

CROSS-REFERENCE TO RELATED APPLICATION

Pursuant to 35 U.S.C. §119(a), this application claims the benefit of earlier filing date and right of priority to Korean Utility Model Application No. 20-2012-0009997, filed on Nov. 1, 2012, the contents of which is incorporated by reference herein in its entirety.

BACKGROUND OF THE DISCLOSURE

1. Field of the Disclosure

The present disclosure relates to a molded case circuit breaker with a large capacity, and particularly, to a molded case circuit breaker capable of reducing an initial operation load without changing a configuration of a switching mechanism, when driving a plurality of movable contact arms for each pole (phase) to a closing position.

2. Background of the Disclosure

A molded case circuit breaker with a large capacity (hereinafter, will be referred to as abbreviated as MCCB with a large capacity) indicates a MCCB capable of increasing a conducting capacity by diverging a conducting path, under a configuration that a plurality of movable contact arms and a plurality of stationary contact arms are provided for each pole of the industrial alternating current (abbreviated as AC hereinafter) three poles (R pole, S pole and T pole) or four poles (R pole, S pole, T pole and N pole).

Korean Patent Registration No. 10-1079012 registered by the applicant of the present invention can be referred to as the conventional art of such MCCB with a large capacity. A MCCB with a large capacity disclosed in Korean Patent Registration No. 10-1079012 has a configuration that a repulsive force to push a plurality of movable contact arms for each pole (phase) to terminals contacting both side surfaces of the movable contact arm is provided by installing disc springs between the movable contact arms. The disc springs are installed in order to stably maintain an electrically-connected state between the movable contact arms and the terminals due to a mechanical contact state therebetween.

In order to open or close (switch) the conventional MCCB, the movable contact arms should be driven by a force greater than a resultant force of a load of a plurality of contact arms which forms the movable contact arms for poles, and a frictional force between the movable contact arms and the terminals due to an elastic force of the disc springs (4 disc springs for each pole) for maintaining an electrically-connected state between the movable contact arms and the terminals.

A driving force to automatically trip the MCCB with a large capacity is strong elastic energy charged to a trip spring having a large elastic coefficient. More specifically, the driving force by the elastic energy charged to the trip spring is much greater than the resultant force of a load of the plurality of contact arms, and a frictional force between the movable contact arms and the terminals due to an elastic force of the disc springs for maintaining an electrically-connected state between the movable contact arms and the terminals. As a result, there occurs no problem when the conventional MCCB operates to trip.

However, a driving force required to manually operate the MCCB with a large capacity to an opening position or closing position is obtained from a user's manual force to manually rotate a handle of the MCCB with a large capacity. Therefore, the user should manually operate the MCCB with a large capacity, with a force greater than the resultant force.

Especially, in a case where the MCCB with a large capacity is manually operated to a closing position (that is ON position), if a driving force is small, a circuit is not closed. Further, if a manual operation to rotate the MCCB to a closing position, heat may occur from a contact portion due to inferior contact between contacts, and electric power may be unstably supplied to the circuit.

SUMMARY OF THE DISCLOSURE

Therefore, an aspect of the present disclosure is to provide a MCCB with a large capacity, capable of reducing an initial operation load when manually operated to a closing position, through addition of a simple configuration.

To achieve these and other advantages and in accordance with the purpose of this disclosure, as embodied and broadly described herein, there is provided a molded case circuit breaker with a large capacity, comprising:

a plurality of stationary contact arms electrically connected to an electric power source side or an electric load side, and each of the stationary contact arms provided for each of alternating current poles;

a plurality of movable contact arms provided in corresponding with the stationary contact arms, rotatable to a closing position to contact the stationary contact arms or an opening position to be separated from the stationary contact arms, each of the movable contact arms installed for each of alternating current poles so as to provide a diverged conducting path, and each having a plurality of contact arm pieces;

a switching mechanism configured to provide a driving force to move the movable contact arms to the closing position or the opening position;

a driving shaft rotatable by driving of the switching mechanism by being connected to the switching mechanism, commonly provided for the plurality of movable contact arms, and configured to simultaneously rotate the movable contact arms to the closing position or the opening position;

a link connected to the driving shaft, and configured to transmit a driving force;

a holder rotated by the link by being connected to the link, and configured to rotate the movable contact arms;

an upper arc barrier configured to prevent arcs from moving to a rear side from an upper side of the movable contact arms; and a torsion spring having one end portion supported by the upper arc barrier, an intermediate supporting portion, and another end portion contacting upper surface of the movable contact arms on the opening position so as to provide an elastic force to the movable contact arms such that the movable contact arms are rotated to the closing position.

In an aspect of the present invention, the upper arc barrier may comprise a pair of supporting protrusions configured to support the intermediate supporting portion of the torsion spring.

In an aspect of the present invention, the torsion spring comprises a double torsion spring.

In an aspect of the present invention, the upper arc barrier is provided with inclined slit portions fixed above the movable contact arms, and configured to guide up-down motion of a connection pin of the link.

Further scope of applicability of the present application will become more apparent from the present disclosure given hereinafter. However, it should be understood that the present disclosure and specific examples, while indicating preferred embodiments of the disclosure, are given by way of illustration only, since various changes and modifications within the spirit and scope of the disclosure will become apparent to those skilled in the art from the present disclosure.

BRIEF DESCRIPTION OF THE DRAWINGS

The accompanying drawings, which are included to provide a further understanding of the disclosure and are incorporated in and constitute a part of this disclosure, illustrate exemplary embodiments and together with the description serve to explain the principles of the disclosure.

In the drawings.

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, a MCCB with a large capacity according to the present invention will be explained in more detail with reference to the attached drawings.

Figure 1:
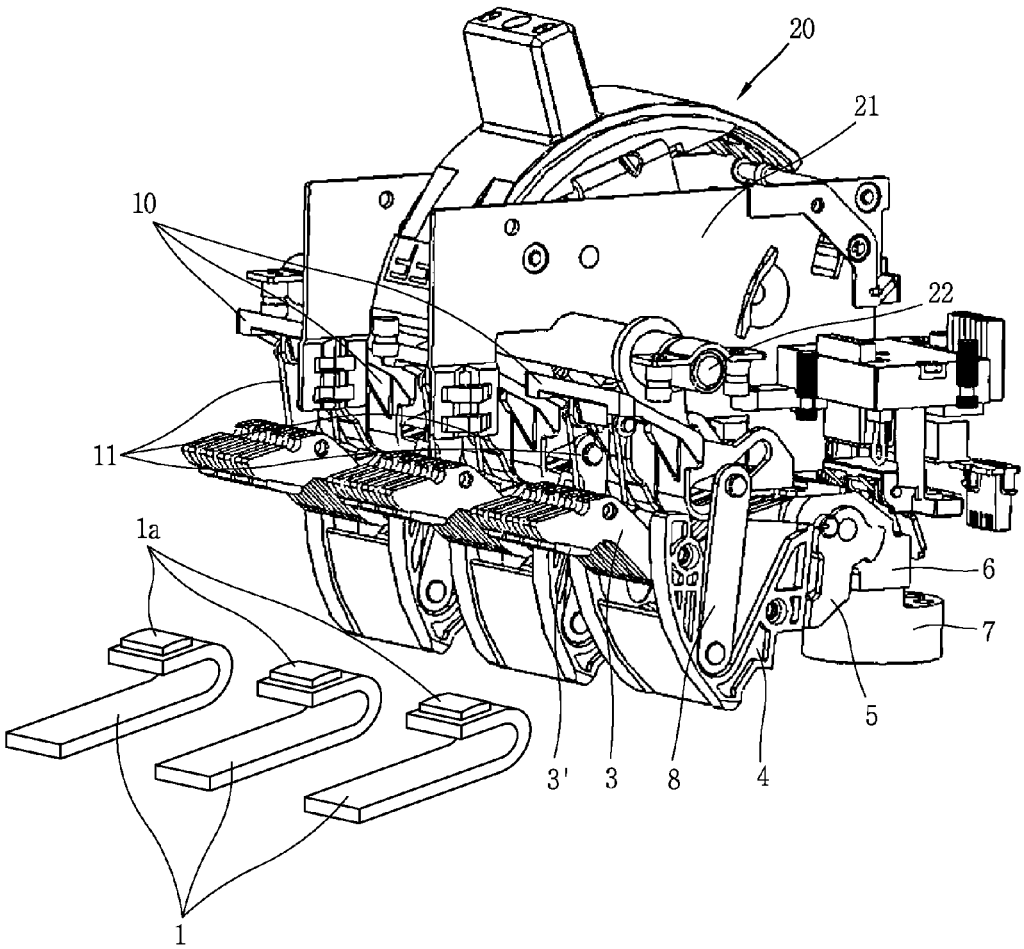
FIG. 1 is a perspective view illustrating a main part of a MCCB with a large capacity according to a preferred embodiment of the present invention, which has been viewed from a front upper region on the right side in an inclined direction.
Figure 2:
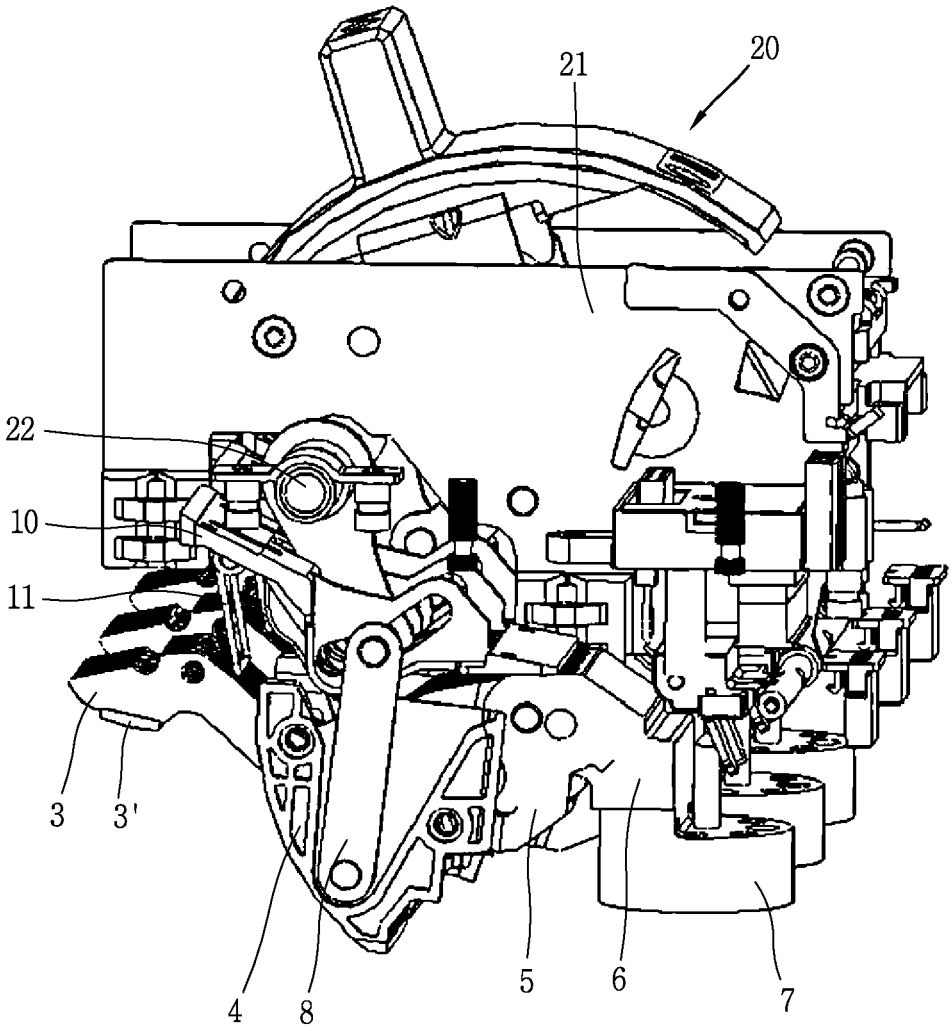
FIG. 2 is a perspective view illustrating a main part of a MCCB with a large capacity according to a preferred embodiment of the present invention, which has been viewed from a rear upper region on the right side in an inclined direction.
Figure 3:
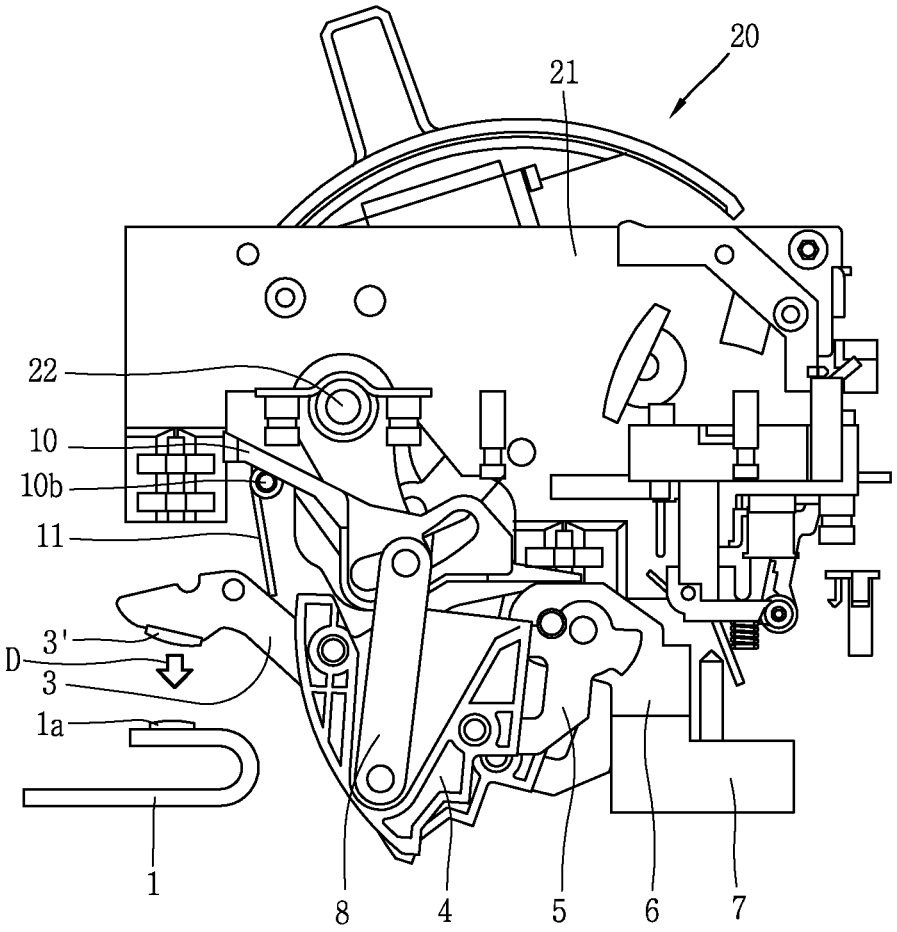
FIG. 3 is a side view illustrating a main part of a MCCB with a large capacity according to a preferred embodiment of the present invention.
Figure 4:
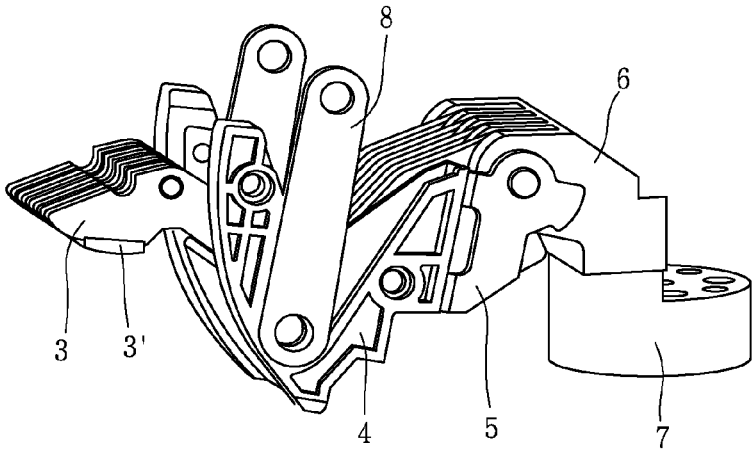
FIG. 4 is a perspective view illustrating a movable contact arm assembly of a MCCB with a large capacity according to an embodiment of the present invention.

Referring to FIGS. 1 to 3, a MCCB with a large capacity according to a preferred embodiment of the present invention comprises stationary contact arms 1, movable contact arms 3, a switching mechanism 20, a driving shaft 22, a link 8, a holder, an upper arc barrier 10 and a torsion spring 11.

The stationary contact arms 1 are electrically connected to an electric power source side or an electric load side, and each of the stationary contact arms 1 is provided for each pole (in other words each phase) of alternating current (AC). And each of the stationary contact arms 1 is configured as electrical conductors, and are fixed to an enclosure (not shown) of the MCCB with a large capacity according to the present invention. In a case where the MCCB with a large capacity according to the present invention is for three poles (phases) AC (i.e., R pole, S pole and T pole), three stationary contact arms 1 may be provided. In a case where the MCCB with a large capacity according to the present invention is for four poles (phases) (i.e., R pole, S pole, T pole and N (neutral) pole) AC, four stationary contact arms 1 may be provided. As shown in FIGS. 1 to 3, the stationary contact arms 1 have a shape of a current limiting type stationary contact arms. More specifically, a contact portion to which a contact 1*a* has been attached is bent in a "U"-shape toward a terminal portion exposed to outside of the MCCB with a large capacity, for connection with an external electric power source side or electric load side.

Under such configuration of the current limiting type stationary contact arms 1, a direction of a current flowing into contact portions of the stationary contact arms 1 is opposite to a direction of a current flowing out through the movable contact arms 3. Accordingly, a magnetic field formed near a conducting path of the current generates an electromagnetic repulsive force. If a fault current such as an over-current or a short-circuit current occurs on an electric power circuit (hereinafter, will be referred to as 'circuit') to which the MCCB is connected, the movable contact arms 3 are separated from the stationary contact arms 1 due to the large electromagnetic repulsive force. As a result, a current limiting operation for limiting a current applied onto the circuit is performed.

The movable contact arms 3 are configured as electrical conductor pieces, and are formed in plurality in corresponding with the stationary contact arms 1. The movable contact arms 3 are rotatable to a closing position to contact the stationary contact arms 1, or an opening position (trip position) to be separated from the stationary contact arms 1.

Figure 5:
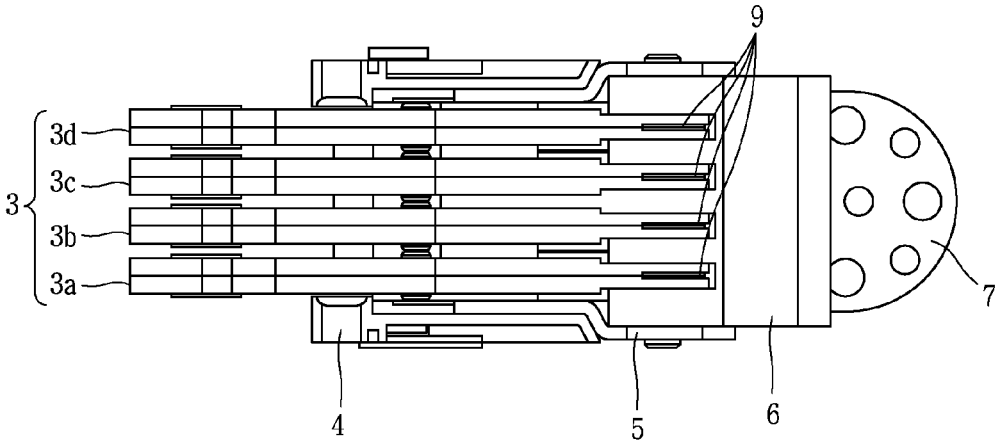
FIG. 5 is a planar view of the movable contact arm assembly of FIG. 4, which has been viewed from an upper side.

For conduction of a current of a large capacity, each movable contact arm 3 is provided with a plurality of contact arm pieces 3*a*, 3*b*, 3*c*, 3*d* of FIG. 5, for each of alternating current (AC) poles. As shown in FIG. 5, each contact arm piece 3*a*, 3*b*, 3*c*, 3*d* is configured as a pair of conductor pieces.

As shown in FIG. 5, a disc spring 9 is installed between a pair of conductor pieces of each contact arm piece 3*a*, 3*b*, 3*c* and 3*d*, thereby providing a repulsive force as elastic force to push each contact arm piece 3*a*, 3*b*, 3*c*, 3*d* outwardly toward the holder.

The switching mechanism 20 serves to provide a driving force to the movable contact arms 3 so that the plurality of movable contact arms 3 can be simultaneously moved to the closing position or the opening position.

As is well-known, the switching mechanism 20 may comprise: a handle which provides a means for manual opening/closing; a lever which provides a rotation supporting point of the handle; a pair of side plates 21 configured to support components of the switching mechanism at two side surfaces; a trip spring configured to provide an elastic driving force for a tripping operation; a latch configured to move the trip spring to a restricting position where elastic energy is charged, and a releasing position where elastic energy is discharged; a latch holder configured to maintain the latch on the restricting position, or to release the latch from the restricting position by a trip mechanism (not shown); and a nail configured to displace the latch holder.

The configuration and operation of a switching mechanism of a MCCB with a large capacity, and the configuration and operation of a MCCB have been disclosed in Korean Patent Registration No. 10-1052645 (Title: Large-capacity MCCB with arc shielding apparatus) registered by the applicant of the present invention. Therefore, more detail disclosures thereof will be omitted.

The driving shaft 22 is connected to the switching mechanism 20, and is rotatable by driving of the switching mechanism 20. The driving shaft 22 is commonly provided for the plurality of movable contact arms 3, and provides a driving force to simultaneously rotate the movable contact arms 3 to a closing position or an opening position.

As shown in FIG. 3, the driving shaft 22 is installed above the movable contact arms 3, in a direction to cross the plurality of movable contact arms 3. Two ends of the driving shaft 22 may be rotatably supported by a supporting portion of an enclosure (not shown).

The link 8, a means for transmitting a driving force by being connected to the driving shaft 22, may include a lower link, an upper link (not shown), and a link member connected to the switching mechanism 20. The configuration of the link 8 has been disclosed in Korean Patent Registration No. 10-1052645 (Title: Large-capacity MCCB with arc shielding apparatus).

The holder is a means that rotates (or supports) the movable contact arms 3 to the closing position or the opening position by being rotated by the link 8 connected thereto. Alternatively, the holder is a means that provides a conducting path connected to the movable contact arms 3. The holder includes a wall holder 4, a holder member 5 and a supporting base.

Preferably, the wall holder 4 is formed of an electrical insulating material. The wall holder 4 includes two side wall portions disposed at both sides of the movable contact arms 3 and providing an electrical insulating portion between phases (poles), and a low shielding portion formed to cross a bottom side of the two side wall portions and configured to shield arcs from moving toward a rear side of the movable contact arms 3 from a lower side of the movable contact arms 3. The wall holder 4 may be connected to the link 8 by a connection pin, to thus be rotatable by transmission of a driving force from the link 8.

As shown in FIG. 5, the holder member 5 is a means to support the movable contact arms 3 and a rotation supporting plate 6 at both sides. The holder member 5 is rotatable by being supported by a rotation shaft (not shown). And the holder member 5 is rotatable by being connected to the wall holder 4 by a connection pin, and by being driven by the link 8. Preferably, the holder member 5 is formed of an electrical insulating material for electrical insulation between phases.

The supporting base, formed of an electrical conductor and providing a conducting path connected to the movable contact arms 3 and a stationary supporting point, includes a rotation supporting plate 6 and a stationary base 7.

The rotation supporting plate 6 is fixed to provide rotation supporting points of the wall holder 4 and the holder member 5. The rotation supporting plate 6 is formed of an electrical conductor. As the movable contact arm pieces 3*a*, 3*b*, 3*c*, 3*d* of the movable contact arms 3 are fitted into plural pairs of the rotation supporting plates 6, the movable contact arm pieces 3*a*, 3*b*, 3*c*, 3*d* are supported by the rotation supporting plates 6 and the movable contact arm pieces 3*a*, 3*b*, 3*c*, 3*d* contacts the rotation supporting plates 6, the rotation supporting plates 6 provides a conducting path following the movable contact arms 3.

As aforementioned, for a stable contact between the rotation supporting plates 6 and the contact arm pieces 3*a*, 3*b*, 3*c*, 3*d* with minimized heat emission, a plurality of disc springs 9 are installed between a pair of conductor pieces of each contact arm piece 3*a*, 3*b*, 3*c* and 3*d*. The disc springs 9 provide an elastic force to each contact arm piece 3*a*, 3*b*, 3*c*, 3*d*, as a repulsive force, a force to push the contact arm piece toward the rotation supporting plate 6.

The stationary base 7 is directly fixed to a bottom portion of an enclosure (not shown) of the MCCB with a large capacity, by a fixing screw or a fixing busbar. The stationary base 7 is connected to the rotation supporting plate 6 by welding, etc., thereby providing a supporting base for supporting the rotation supporting plate 6. And the stationary base 7 is formed as a disc-shaped electrical conductor of a prescribed thickness, thereby providing a conducting path connected to the movable contact arms 3. The stationary base 7 may be electrically connected to a terminal portion through a flexible wire (not shown) formed of a conductor busbar or a flexible conductor. The terminal portion is connected to an electric power source outside the MCCB, or an electric load side wire.

Figure 6:
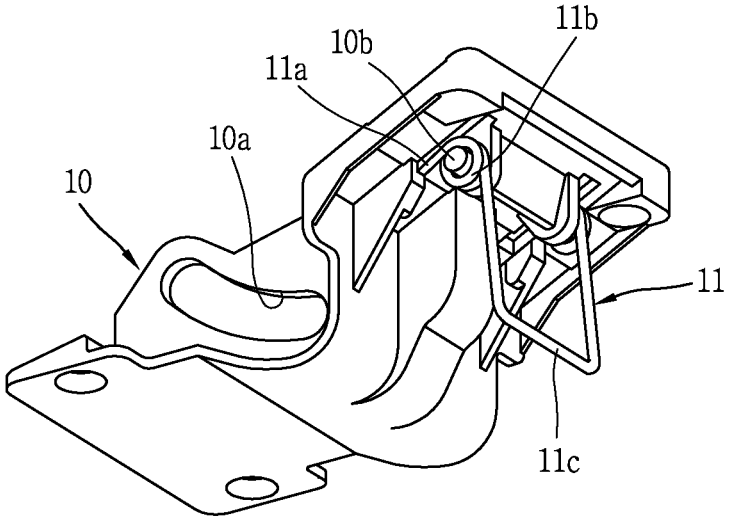
FIG. 6 is a perspective view illustrating an assembly of an upper arc barrier and a torsion spring in a MCCB with a large capacity according to an embodiment of the present invention, which has been viewed from a lower side in an inclined direction.

The upper arc barrier 10 is configured as a plate formed of an electrical insulating material, and prevents arcs from moving to a rear side from an upper side of the movable contact arms 3. The rear side of the movable contact arms 3 indicates an opposite side to contacts 3' of the movable contact arms 3. As shown in FIG. 6, for shield of movement of arcs, the upper arc barrier 10 includes plate portions formed at two ends thereof in a longitudinal direction, a vertical shielding wall portion formed at an intermediate part thereof, and an inclined bottom portion extending from the vertical shielding wall portion toward the plate portions with an inclination angle.

Figure 7:
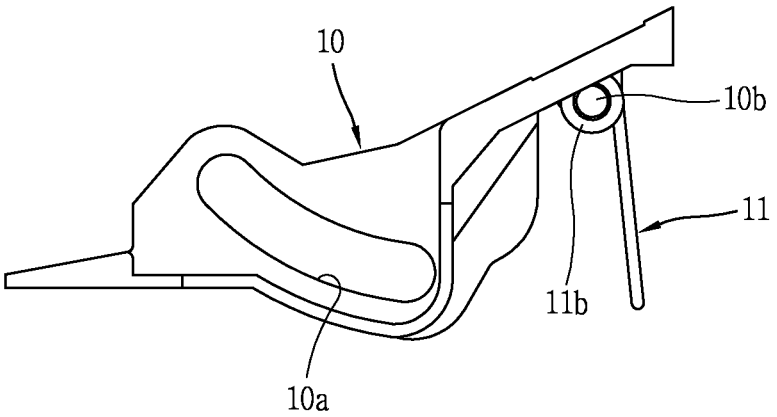
FIG. 7 is a side view of the assembly of an upper arc barrier and a torsion spring of FIG. 6.

Referring to FIGS. 1 to 3, the upper arc barrier 10 is fixed above the movable contact arms 3. Referring to FIGS. 6 and 7, the upper arc barrier 10 is provided with a pair of inclined slit portions 10*a* configured to guide up-down motion of a connection pin (not shown, refer to a circular protrusion in an upper part of the link 8 in FIG. 1) of the link 8. As shown in FIGS. 6 and 7, the pair of inclined slit portions 10*a* are disposed on two side walls of the inclined bottom portion.

The upper arc barrier 10 may be fixed to an intermediate partition wall (not shown) of an enclosure of the MCCB, by a fixing screw. The intermediate partition wall is formed of an electrical insulating material, and is configured to partition an upper side and a lower side of the MCCB from each other.

As shown in FIGS. 6 and 7, the upper arc barrier 10 includes a pair of supporting protrusions 10*b* configured to support an intermediate supporting portion 11*b* of a torsion spring 11 to be explained later. The pair of supporting protrusions 10*b* protrude from side surfaces of a pair of protruding plate portions downward protruding from a bottom surface of one of the plate portions.

Referring to FIG. 6, the torsion spring 11 includes: one end portion 11*a* supported at a bottom surface of the upper arc barrier 10; an intermediate supporting portion 11*b*, an intermediate torsion ring portion supported by being fitted onto the pair of supporting protrusions 10*b* of the upper arc barrier 10; and another end portion contacting an upper surface of the movable contact arms 3 on the opening position so as to provide an elastic force to the movable contact arms 3 so that the movable contact arms 3 can be rotated to the closing position.

Preferably, the torsion spring 11 is configured by a double torsion spring so as to elastically-bias the movable contact arms while evenly contacting the upper surface of the movable contact arms.

The operation of the MCCB with a large capacity according to the present invention will be explained in more detail with reference to the attached drawings.

Firstly, an operation to move the MCCB to a closing position from an opening position (trip position) will be explained.

Referring to FIGS. 1 to 3, in order to move the MCCB to a closing position (ON position) from an opening position (trip position), a user should grasp a handle of the switching mechanism 20.

If a user grasps the handle of the switching mechanism 20 to move the MCCB to a closing position (ON position), the driving shaft 22 is clockwise rotated by a manual force transmitted from the lever and the link member of the switching mechanism.

Then, a circular arc-shaped upper link (not shown) connected to the driving shaft 22 is clockwise rotated, and a lower link (refer to the portion numeral 8 designates) connected to the upper link by a connection pin is counterclockwise rotated.

Therefore, the wall holder 4 connected to the lower link 8, the holder member 5 connected to the wall holder 4, and the movable contact arms 3 connected to the holder member 5 by a connection pin are counterclockwise rotated (in a direction of 'D' in FIG. 3), and the movable contact arms 3 contact the corresponding stationary contact arms 1 as shown in FIG. 1 or 3. As a result, the closing operation is completed.

The MCCB according to the present invention includes the torsion spring 11 having one end portion supported at the upper arc barrier 10, and another end portion contacting the upper surface of the movable contact arms 3 on an opening position ('OFF' position) so as to provide an elastic force to the movable contact arms 3 such that the movable contact arms 3 are rotated to a closing position. Under such configuration, the torsion spring 11 elastically-biases the movable contact arms 3 to a closing position on an opening position. Accordingly, an initial operation load can be significantly reduced when the MCCB with a large capacity is manually operated to a closing position.

Secondly, an operation to move the MCCB to an opening position (trip position) from a closing position will be explained.

If a user grasps the handle of the switching mechanism 20 for an opening position, of if a trip mechanism (not shown) triggers the switching mechanism 20 due to a fault current such as an over-current or a short-circuit current occurring on a circuit, the driving shaft 22 is counterclockwise rotated by a massive force transmitted from the lever and the link member of the switching mechanism 20.

Then, a circular arc-shaped upper link (not shown) connected to the driving shaft 22 is counterclockwise rotated, and the lower link connected to the upper link by a connection pin is clockwise rotated.

Therefore, the wall holder 4 connected to the lower link 8, the holder member 5 connected to the wall holder 4, and the movable contact arms 3 connected to the holder member 5 by a connection pin are clockwise rotated (in an opposite direction of 'D' in FIG. 3), and the movable contact arms 3 are separated from the corresponding stationary contact arms 1 as shown in FIG. 1 or 3. As a result, the breaking operation (trip operation) is completed.

As aforementioned, the MCCB according to the present invention includes the torsion spring 11 having one end portion supported at the upper arc barrier 10, and another end portion contacting the upper surface of the movable contact arms 3 on an opening position so as to provide an elastic force so that the movable contact arms 3 can be rotated to a closing position. Under such configuration, the torsion spring 11 elastically-biases the movable contact arms 3 to a closing position on an opening position. Accordingly, an initial operation load can be significantly reduced when the MCCB with a large capacity is manually operated to a closing position.

In the MCCB with a large capacity according to the present invention, the upper arc barrier 10 includes a pair of supporting protrusions 10*b* configured to support the intermediate supporting portion 11*b* of the torsion spring 11. As the intermediate supporting portion 11*b* is supported by the supporting protrusions 10*b*, the torsion spring 11 can be installed in a simple manner.

In the MCCB with a large capacity according to the present invention, the torsion spring 11 is configured as a double torsion spring. Therefore, the torsion spring can elastically-bias the movable contact arms 3 to a closing position while evenly contacting the upper surface of the movable contact arms 3.

In the MCCB with a large capacity according to the present invention, the upper arc barrier 10 is fixed above the movable contact arms 3, and is provided with a pair of inclined slit portions 10*a* configured to guide up-down motion of a connection pin of the link 8. Accordingly, up-down motion of the connection pin of the link 8 for moving the movable contact arms 3 to a closing position or an opening position can be accurately guided by the inclined slit portions 10*a*.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A molded case circuit breaker, comprising:

a plurality of stationary contact arms electrically connected to an electric power source side or an electric load side, and each of the stationary contact arms provided for each of a plurality of alternating current poles;

a plurality of movable contact arms provided in correspondence with the stationary contact arms, rotatable to a closing position to contact the stationary contact arms or an opening position to be separated from the stationary contact arms, each of the movable contact arms provided for each of the plurality of alternating current poles so as to provide a diverged conducting path, and each having a plurality of contact arm pieces;

a switching mechanism configured to provide a driving force to move the movable contact arms to the closing position or the opening position;

a driving shaft rotatable by driving of the switching mechanism by being connected to the switching mechanism, commonly provided for the plurality of movable contact arms, and configured to simultaneously rotate the movable contact arms to the closing position or the opening position;

a link connected to the driving shaft, and configured to transmit a driving force;

a holder rotated by the link by being connected to the link, and configured to rotate the movable contact arms;

an upper arc barrier configured to prevent arcs from moving to a rear side from an upper side of the movable contact arms; and a torsion spring having one end portion supported by the upper arc barrier, an intermediate supporting portion, and another end portion contacting upper surface of the movable contact arms on the opening position so as to provide an elastic force to the movable contact arms such that the movable contact arms are rotated to the closing position.

2. The molded case circuit breaker of claim 1, wherein the upper arc barrier comprises a pair of supporting protrusions configured to support the intermediate supporting portion of the torsion spring.

3. The molded case circuit breaker of claim 1, wherein the torsion spring comprises a double torsion spring.

4. The molded case circuit breaker of claim 1, wherein the upper arc barrier is provided with inclined slit portions fixed above the movable contact arms, and configured to guide up-down motion of a connection pin of the link.

* * * * *